US011041683B2

(12) United States Patent
Lowe

(10) Patent No.: US 11,041,683 B2
(45) Date of Patent: Jun. 22, 2021

(54) RIFLE CHARGING HANDLE CONVERTER BULLCHARGER

(71) Applicant: Laura Annette Lowe, Jonesborough, TN (US)

(72) Inventor: Laura Annette Lowe, Jonesborough, TN (US)

( * ) Notice: Subject to any disclaimer, the term of this patent is extended or adjusted under 35 U.S.C. 154(b) by 286 days.

(21) Appl. No.: 16/104,784

(22) Filed: Aug. 17, 2018

(65) Prior Publication Data

US 2019/0056189 A1 Feb. 21, 2019

Related U.S. Application Data

(60) Provisional application No. 62/546,978, filed on Aug. 17, 2017.

(51) Int. Cl.
*F41A 3/72* (2006.01)
*F41C 27/00* (2006.01)

(52) U.S. Cl.
CPC ..... *F41A 3/72* (2013.01); *F41C 27/00* (2013.01)

(58) Field of Classification Search
CPC ..... F41A 3/72; F41C 27/00
USPC ..... 89/1.4
See application file for complete search history.

(56) References Cited

U.S. PATENT DOCUMENTS 5,214,233 A * 5/1993 Weldle ..... F41A 3/72 89/1.4
6,019,024 A * 2/2000 Robinson ..... F41A 3/72 89/1.42
7,231,861 B1 * 6/2007 Gauny ..... F41A 3/72 42/16
8,117,954 B1 * 2/2012 Davis ..... F41A 3/72 89/1.4
8,567,301 B1 * 10/2013 Sharron ..... F41A 3/72 89/1.4
8,863,632 B1 * 10/2014 O'Malley ..... F41A 3/72 89/1.4
10,598,451 B1 * 3/2020 Haidu ..... F41A 3/72
2010/0000396 A1 * 1/2010 Brown ..... F41A 3/72 89/1.4
2011/0083551 A1 * 4/2011 Sirochman ..... F41A 7/00 89/191.01
2012/0042769 A1 * 2/2012 Makayama ..... F41A 9/38 89/1.4
2013/0061737 A1 * 3/2013 Brown ..... F41A 3/72 89/1.4
2014/0060294 A1 * 3/2014 Brown ..... F41A 5/24 89/1.4
2014/0345444 A1 * 11/2014 Hillman ..... F41A 7/02 89/1.4

(Continued)

*Primary Examiner* — Joshua E Freeman
*Assistant Examiner* — Bridget A Cochran

(57) ABSTRACT

The present invention, BullCharge, is a device that converts the charging handle of an AR, M4, or SR25 flat top rifle to a side charger. The BullCharger device is conveniently installed on either side of the Picatinny riser rail of the rifle using bolts and cap nuts through the slots on the flange of the BullCharger block. This installation does not require the removal of any existing components. By pulling the BullCharger handle backward, the rod within the block engages and pulls the rifle charging handle till the end. Subsequently, the BullCharger handle is released, causing the rifle charging handle to return. And a round is loaded to the chamber to set the rifle ready for use.

12 Claims, 14 Drawing Sheets

(56) References Cited

U.S. PATENT DOCUMENTS

| | | | | |
|---|---|---|---|---|
| 2015/0184958 | A1* | 7/2015 | Becker | F41A 3/72 89/1.4 |
| 2018/0195820 | A1* | 7/2018 | Noonan | F41G 11/003 |

* cited by examiner

RIFLE CHARGING HANDLE CONVERTER BULLCHARGER

The current application claims a priority to the U.S. Provisional Patent application Ser. No. 62/546,978 filed on Aug. 17, 2017.

FIELD OF THE INVENTION

The present invention relates to rifle accessories. More specifically, the present invention, BullCharger, comprises a steel rod positioned within in a slotted aircraft grade aluminum block. When the present invention is mounted to a riser rail on an AR, M4, or SR25 flat top rifle, the steel rod, with a handle attached by a plurality of fasteners to the rod, moves backward by pulling the handle to engage the existing charging handle on the rear of the rifle.

BACKGROUND OF THE INVENTION

The charging handle of flat top AR, M4, or SR25 rifles is a critical component that enables a user to load a round into the firing chamber by pulling and releasing the handle. Located on the rear section above the buffer tube, the charging handle is a T-shaped, rod type handle below the rear side scope on a Picatinny rail. The action of the user pulling the charging handle back causes a long channel with a hole in one end to push existing charging handle, and forcing the hammer down to cock the rifle. At the same time the bolt is pulled back against a spring and a cartridge is forced to move up. When the handle is pulled back to the end and the user's hand is released, the bolt moves forward stripping the cartridge out of the magazine into the chamber. The charging handle not only allows the user to chamber a round, but also to normally extract or clear a double feed and to remove an empty case that won't eject due to malfunction. However, the location and operation of a standard charging handle for an AR, M4, or SR25 flat top rifle, such as AR-15, has been awkward and can become difficult to the point that the user wishes to have a third joint in the user's thumb. Additionally, the standard charging handle is extremely difficult to reach while using a scope. Thus, there has been an increasing demand for a more convenient charging apparatus to solve these problems. One type of popular apparatus is a converter that turns the top operating charging handle into a side charger. Most devices of this type replace the standard charging handle with proprietary design, which are normally expensive and are not compatible with the existing charging handle. A few devices that are on the market which do work with the existing charging handle, but they lack sturdiness and ambidexterity.

An objective of the present invention overcomes the aforementioned problems of a standard charging handle and a replacement charging handle converter. The present invention, the BullCharger, includes a rod that slides in and out of the hole of a block by a handle connected to the rod using a plurality of fasteners. When the BullCharger is mounted to the side of the flat top rifle through the slots on the riser rail, the rod is aligned and in contact with the charging handle of the rifle. The user can hold the rifle with one hand and aim at the target which pulls the BullCharger backward to engage the charger handle to load a round and prepare to fire. The BullCharger works with the existing charging handle and can be installed on either a left or right-hand ejecting AR, M4, or SR25 rifle, and thus provides ambidexterity to the user. The BullCharger must be installed on the opposite side of the ejecting port of the rifle. Installed onto the Picatinny riser rail with bolts and cap nuts, the BullCharger provides the user a stable, reliable, and efficient side charging handle for flat top rifles including, but not limited to, AR-10, AR-15, SR-25, and M4, etc.

DETAIL DESCRIPTIONS OF THE INVENTION

All illustrations of the drawings are for the purpose of describing selected versions of the present invention and are not intended to limit the scope of the present invention.

Figure 1:
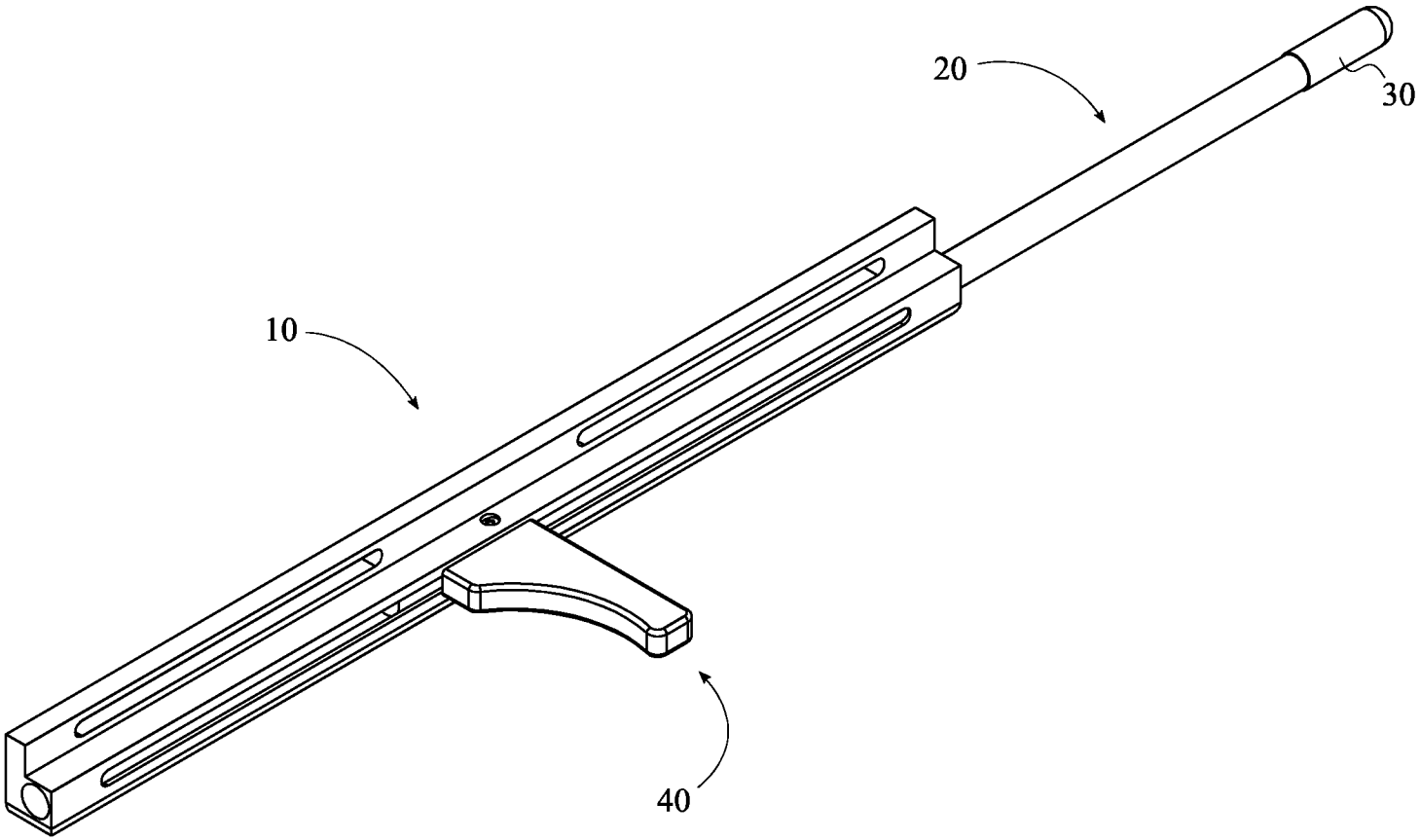
FIG. 1 is an isometric perspective view of the preferred embodiment of the present invention.
Figure 2:
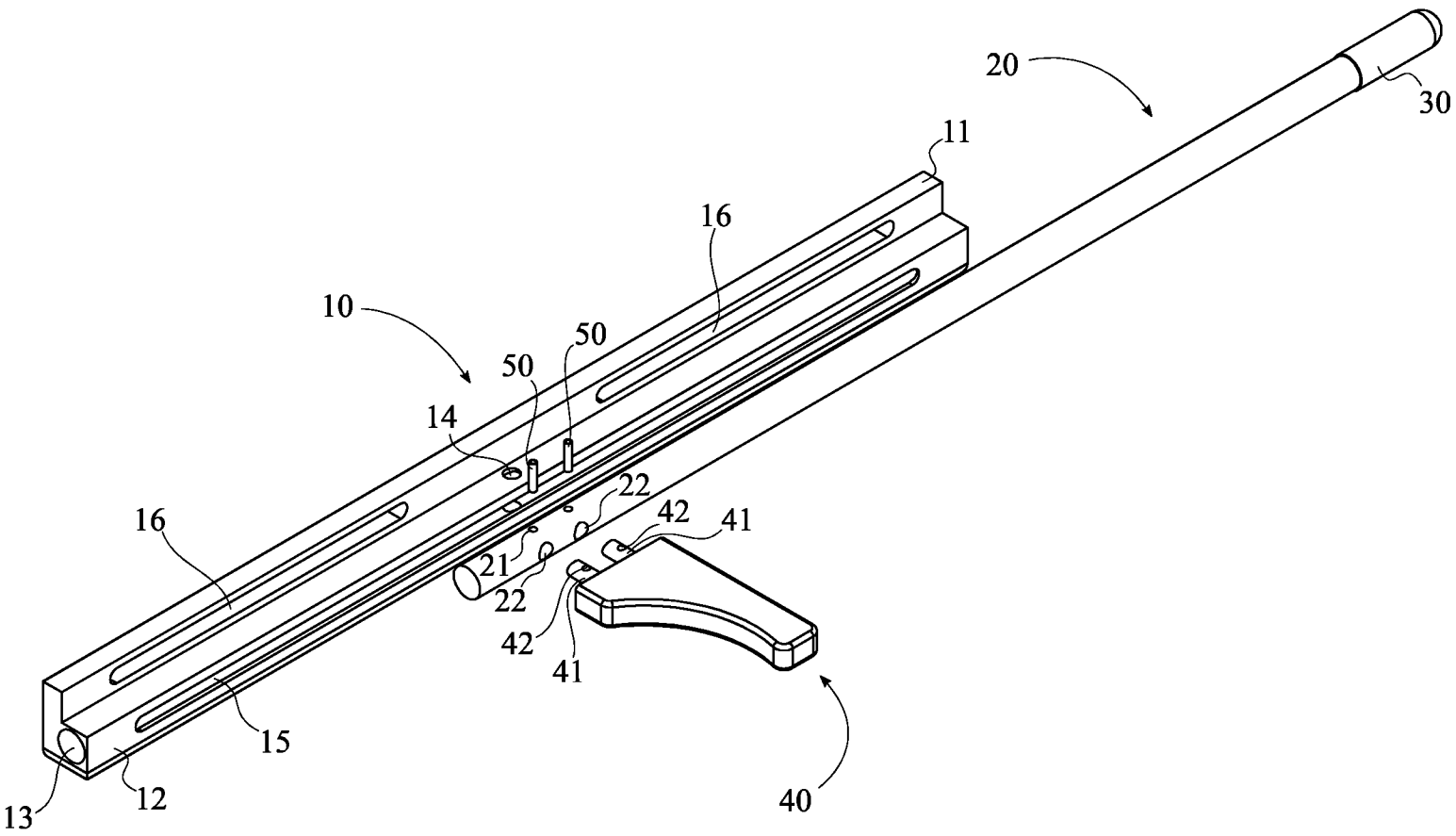
FIG. 2 is an exploded view of the preferred embodiment of the present invention, showing the plurality of pins of the handle.
Figure 4:
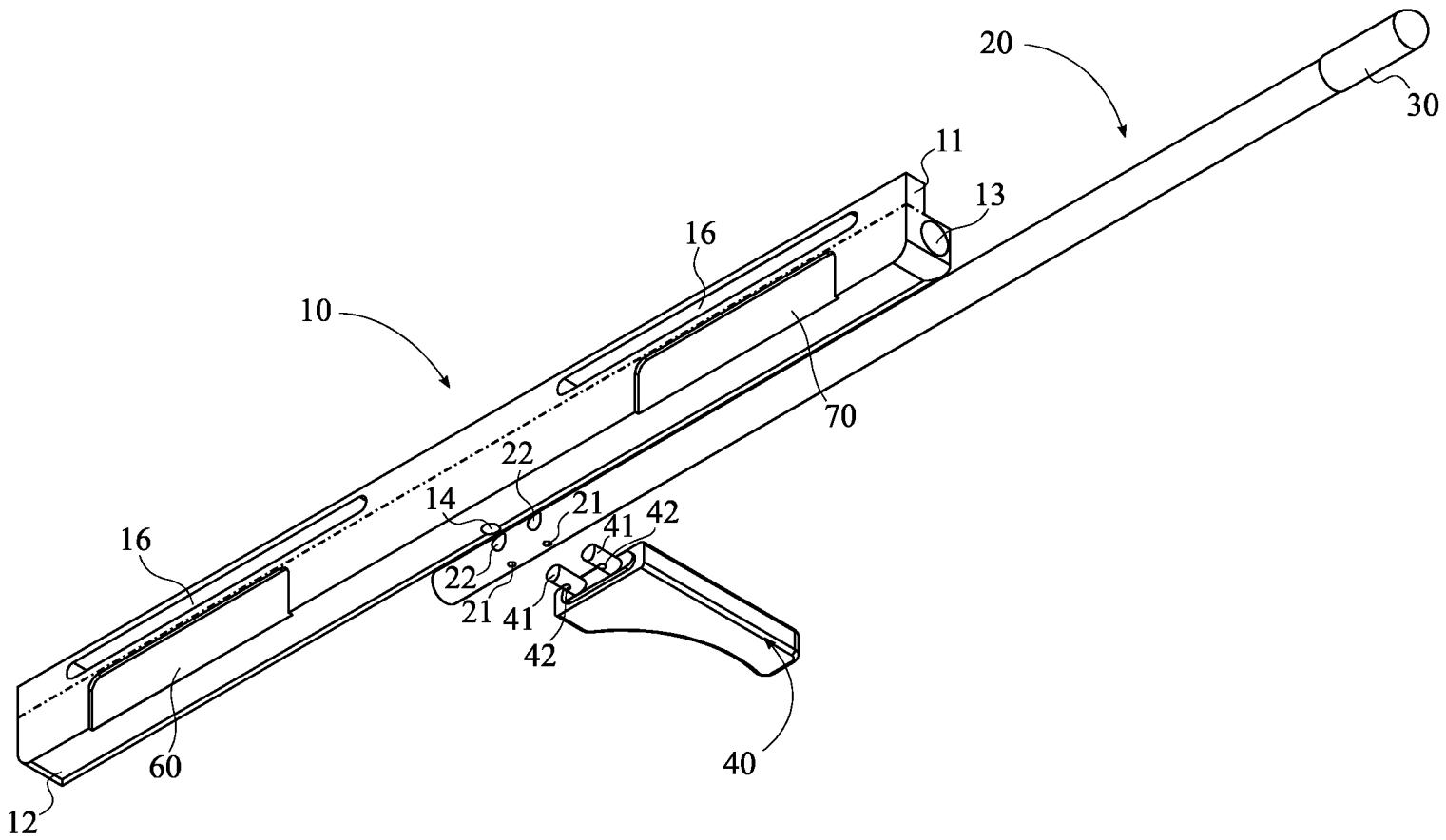
FIG. 4 is a rear view of the preferred embodiment of the present invention.
Figure 5:
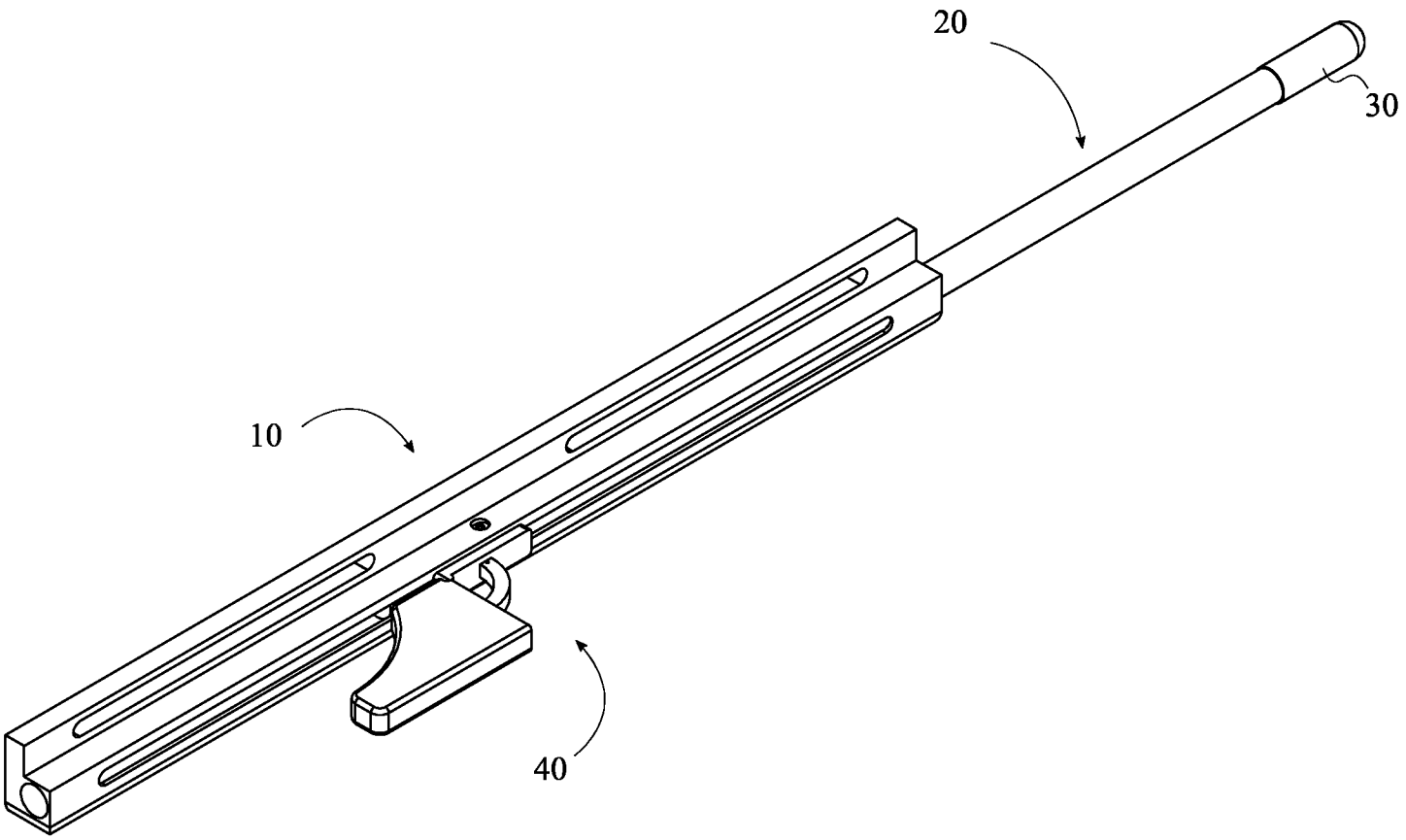
FIG. 5 is an isometric perspective view of another embodiment of the present invention, showing the foldable handle.

As seen in FIGS. 1-2, and 4, the present invention, BullCharger, comprises a block 10, a rod 20, an end stopper 30, a handle 40, a plurality of fasteners 50, and at least one indentation 60. The block 10 comprises a flange 11, a block body 12, a first through hole 13, a second through hole 14, a handle sliding slot 15, and a plurality of slots 16. The handle sliding slot 15 is positioned on the longitudinal side of the block body 12, opposite the flange 11 along the adjacent lateral surface. The first through hole 13 traverses through the block body 12 of the block 10. The second through hole 14 is positioned at the center of the longitudinal side of the block body 12, perpendicular to the first through hole 13. The rod 20 is concentrically and slidably positioned within the first through hole 13 of the block 10. The rod 20 comprises a first plurality of through holes 21. The end stopper 30 is terminally and concentrically mounted to the rod 20 opposite the first plurality of through holes 21. The end stopper 30 is made of materials to protect the end surface of the rod 20, and also the surface of the charging handle on an AR, M4, or SR25 flat top rifle. In the preferred embodiment of the present invention, as seen in FIGS. 1-2, the end stopper 30 is made of rubber, and removably attached to the rod 20, thus, the end stopper 30 can be replaced due to tear and wear. Any other suitable materials can be used for the end stopper 30 in other embodiments of the present invention. The preferred shape of the end stopper 30 is cylindrical, but any other suitable shapes can be used in other embodiments of the present invention. In the preferred embodiment of the present invention, the rod 20 is made of steel, and the block 10 is made of aircraft grad aluminum. Any other suitable materials can be used for the block 10 and rod 20 in other embodiments of the present invention.

In the preferred embodiment, as seen in FIGS. 1-2, 4, and 10, the rod 20 comprises a first plurality of through holes 21 and a second plurality of though holes 22. Each of the first plurality of through holes 21 is oriented perpendicular to each of the second plurality of through holes 22. Each of the first plurality of through holes 21 is positioned at the same location on the rod 20 as one of the second plurality of through holes 22. The handle 40 comprises a plurality of pins 41 and a plurality of through holes 42. The plurality of pins 41 is terminally positioned to the handle 40. Each of the plurality of through holes 42 is aligned with one of the plurality of pins 41 and oriented perpendicular to the longitudinal axis of each of the plurality of pins 41. The shape of the each of the plurality of pins 41 is cylindrical. Any other shapes including, but not limited to, rectangular, square, etc., can be used in other embodiments. As seen in FIGS. 2 and 4, the handle 40 is terminally connected to the rod 20 through the handle sliding slot 15 of the block 10 by first inserting the plurality of pins 41 into each of the second plurality of through holes of the rod 20, then inserting and tightening the plurality of fasteners 50 into the first plurality of through holes 22 of the rod 20 and each of the plurality of pins 41 of the handle 40. The plurality of fasteners 50 is a roll pin. In other embodiments of the present invention, the plurality of fasteners 50 for attaching the handle 40 to the rod 20 can be a screw, a bolt and a nut, etc. The preferred shape of the handle is curved on one longitudinal side and straight on the opposite side as FIGS. 2 and 4 illustrate. Other embodiments can have any other shapes of the handle.

Figure 3:
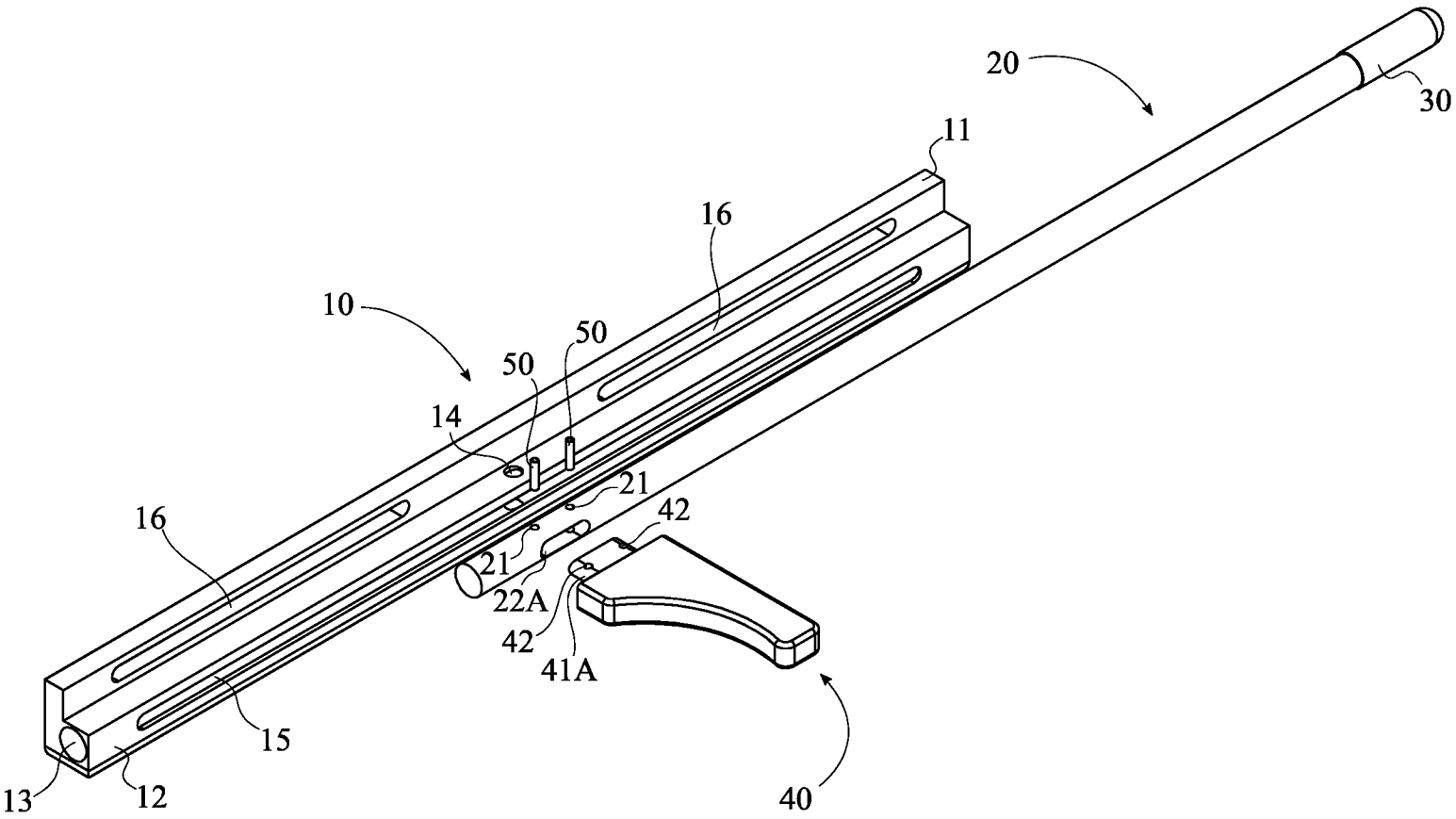
FIG. 3 is an exploded view of another embodiment of the present invention, showing the protrusion of the handle.
Figure 11:
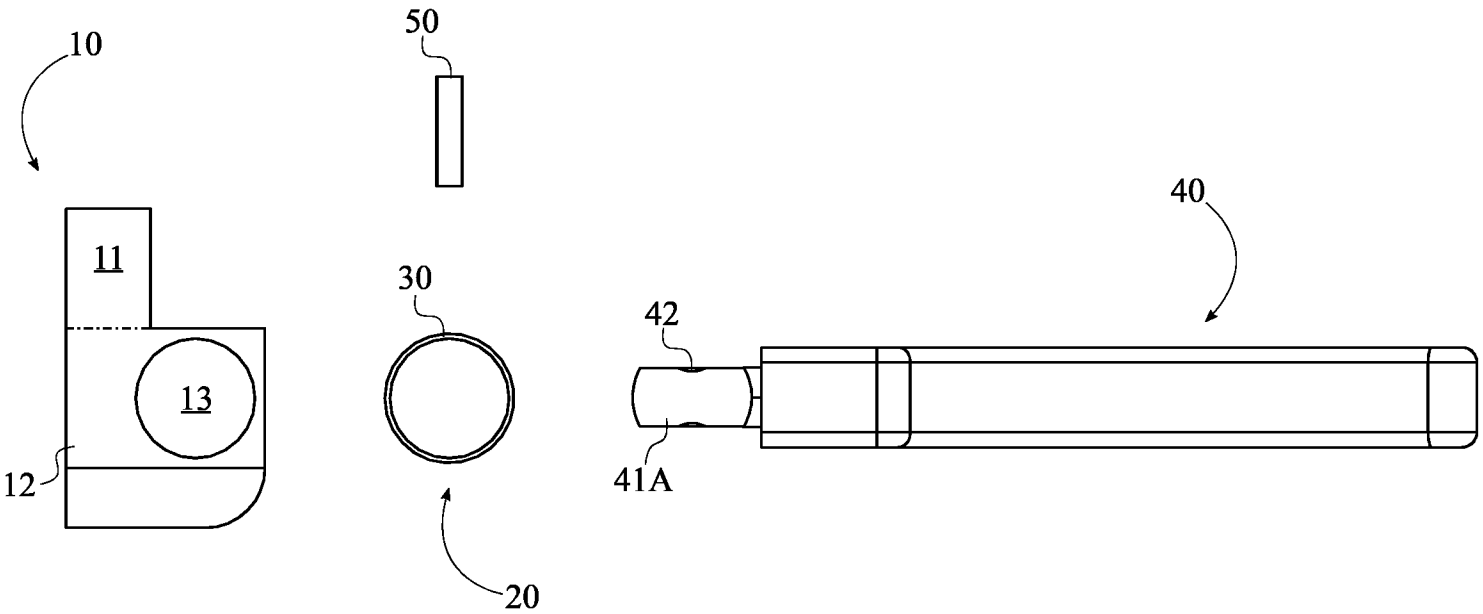
FIG. 11 is a front view of another embodiment of the present invention, showing the protrusion of the handle.
Figure 12:
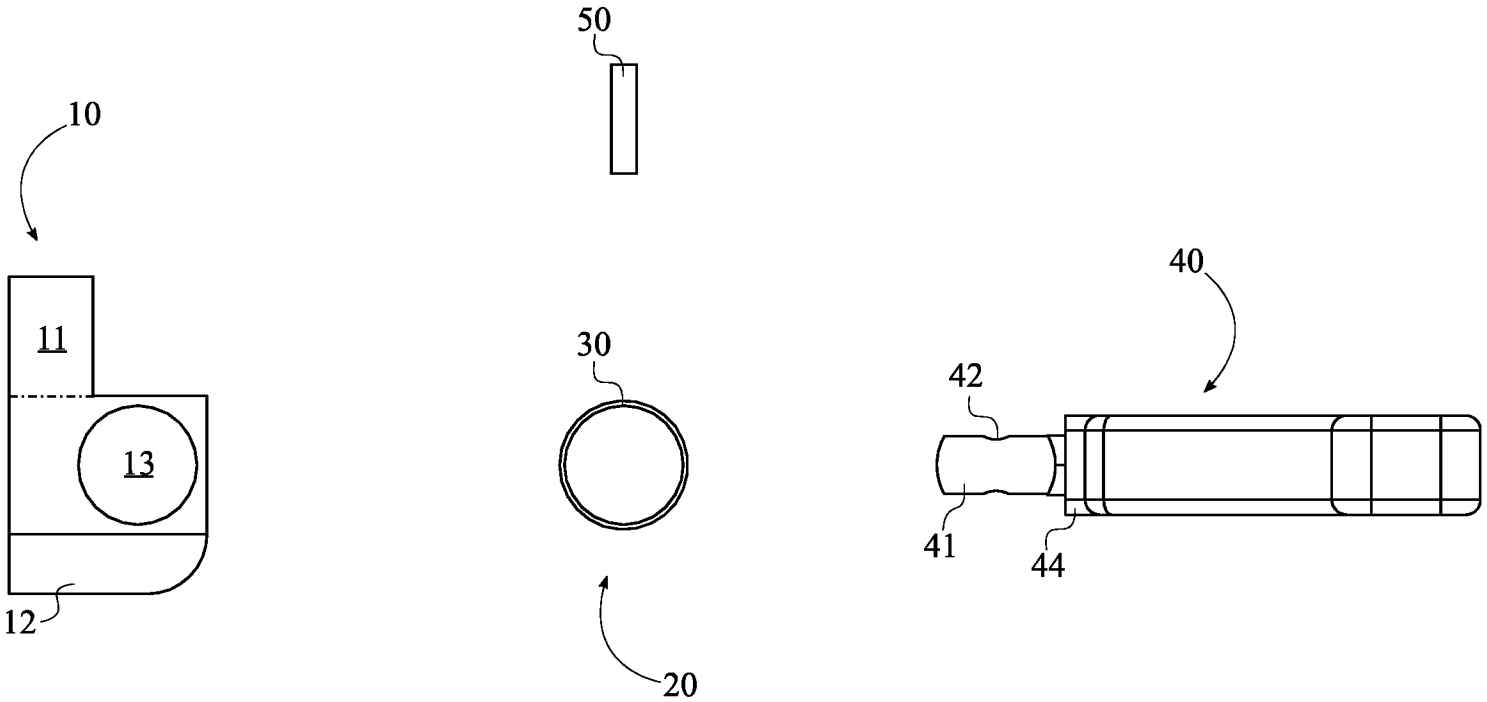
FIG. 12 is a front view of another embodiment of the present invention, showing the foldable handle and the plurality of pins of the bracket.

In another embodiment, as seen in FIGS. 3 and 11, the rod 20 comprises the first plurality of through holes 21 and a slot 21A. The slot 21A is positioned on the distal surface of the rod 20. Each of the first plurality of through holes 21 is oriented perpendicular to slot 21A. The handle 40 comprises a protrusion 41A and a plurality of through holes 42. The protrusion 41A is terminally positioned to the handle 40. Each of the plurality of through holes 42 traverses through the protrusion 41A and is oriented perpendicular to the longitudinal surface of the protrusion 41A. The shape of the protrusion 41A is rectangular with rounded lateral ends. Any other shapes including, but not limited to, elliptical, oval, square, etc., can be used in other embodiments. As seen in FIG. 3, the handle 40 is terminally connected to the rod 20 through the handle sliding slot 15 of the block 10 by first inserting the protrusion 41A into the slot 22A of the rod 20, then inserting and tightening the plurality of fasteners 50 into the plurality of through holes 42 of the protrusion 41A of the handle 40.

Figure 6:
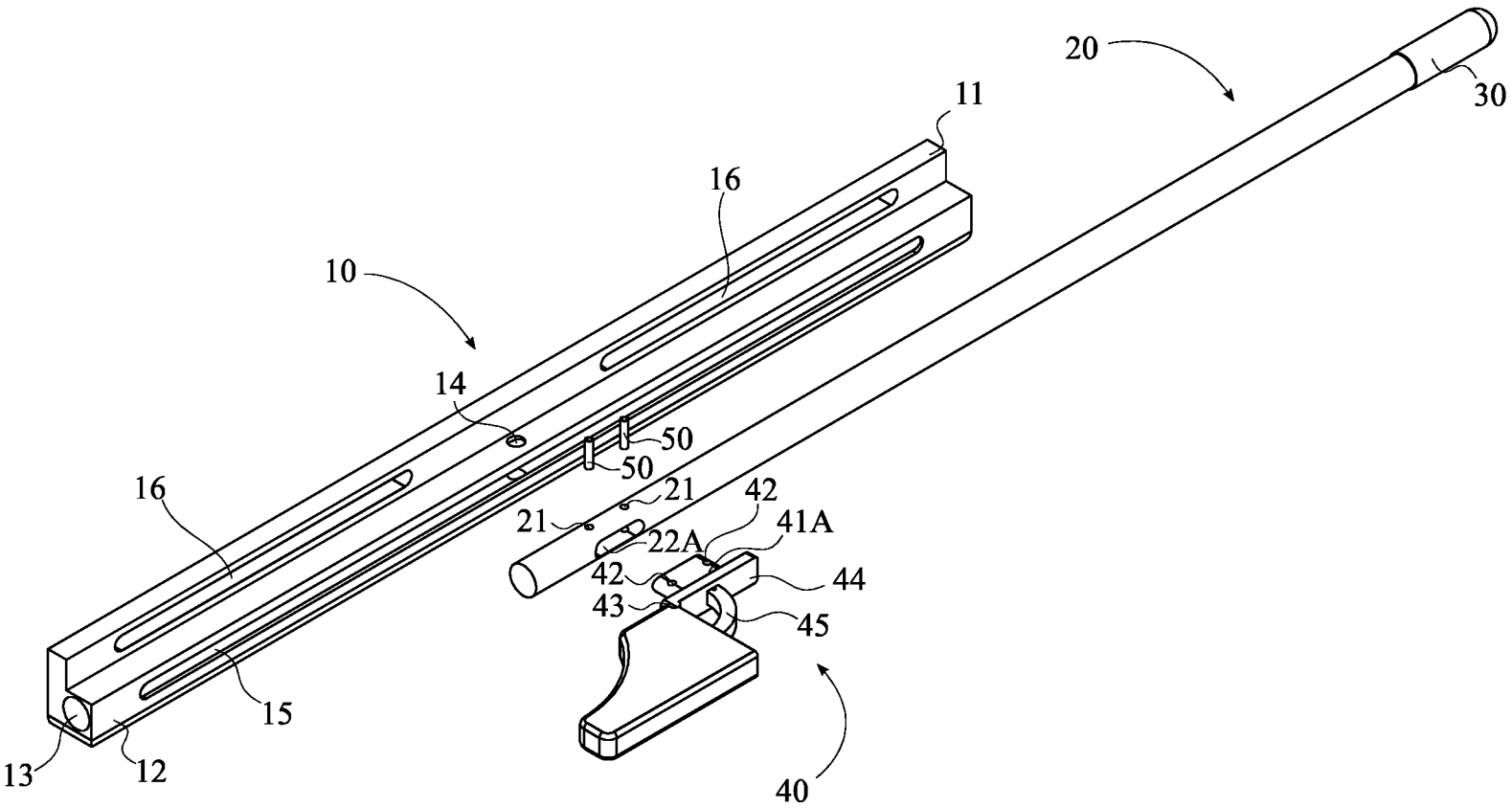
FIG. 6 is an exploded view of another embodiment of the present invention, showing the foldable handle and the protrusion of the bracket.
Figure 7:
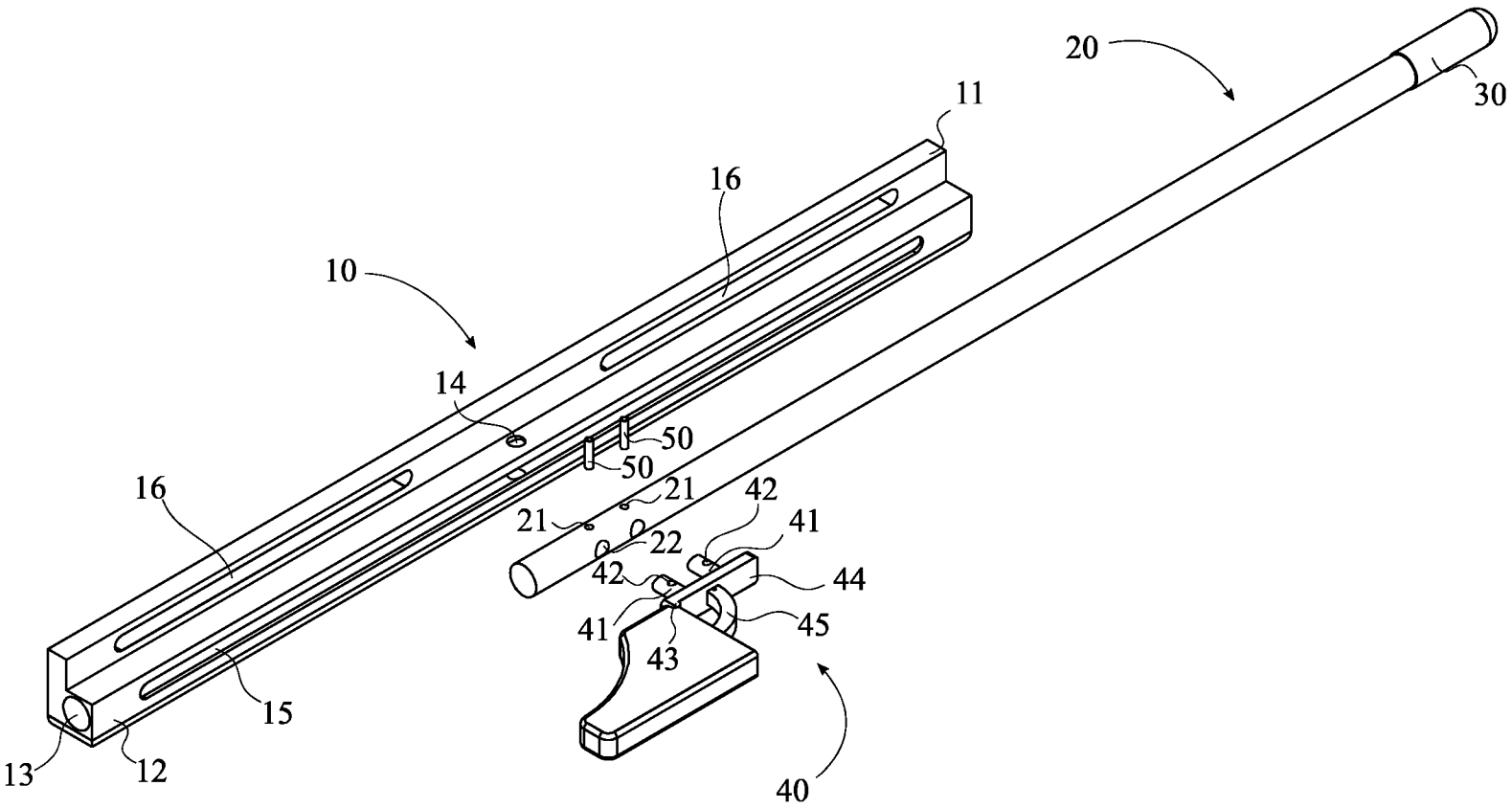
FIG. 7 is an exploded view of another embodiment of the present invention, showing the foldable handle and the plurality of pins of the bracket.
Figure 8:
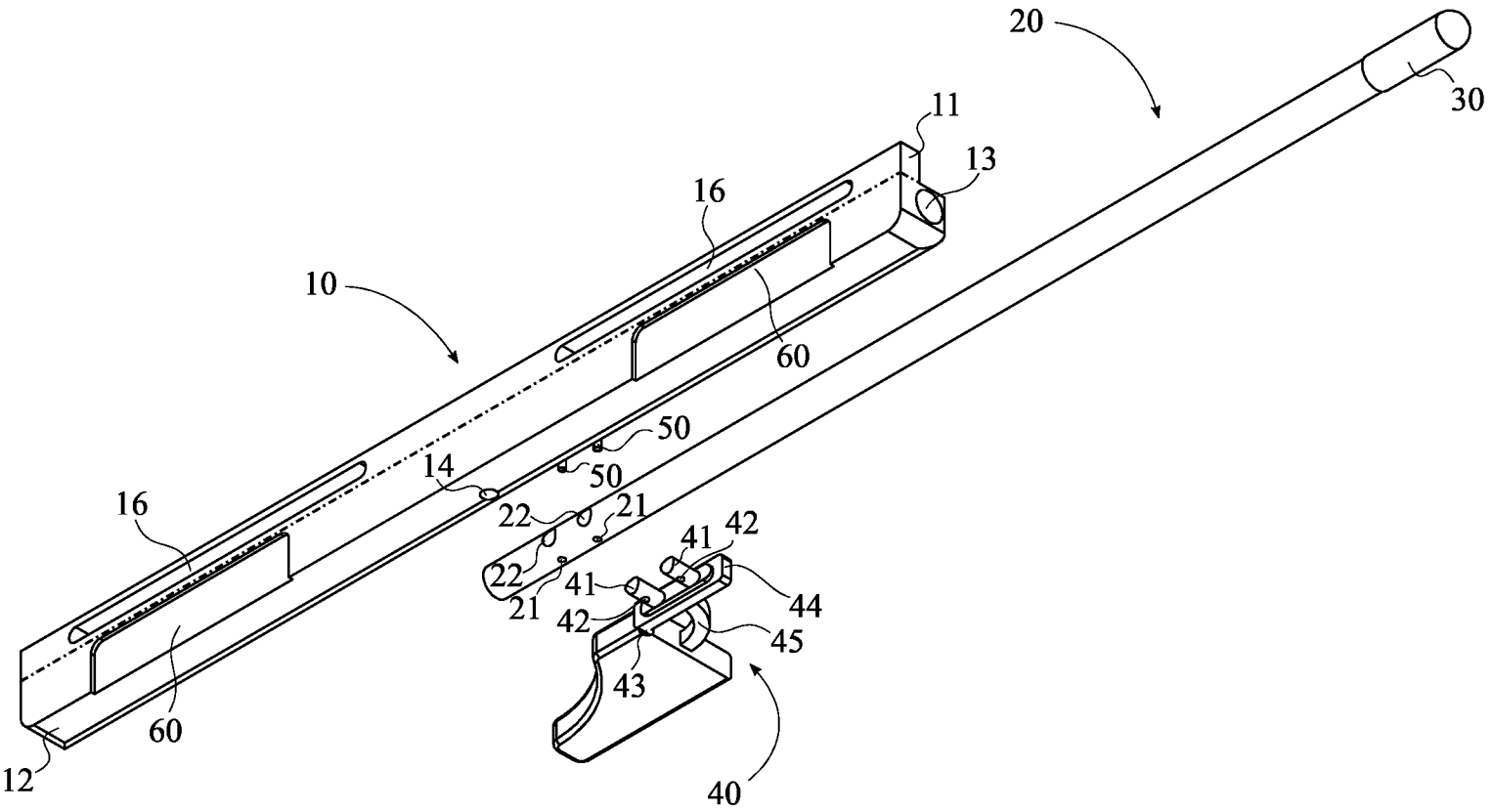
FIG. 8 is a rear view of another embodiment of the present invention, showing the foldable handle and the plurality of pins of the bracket.
Figure 9:
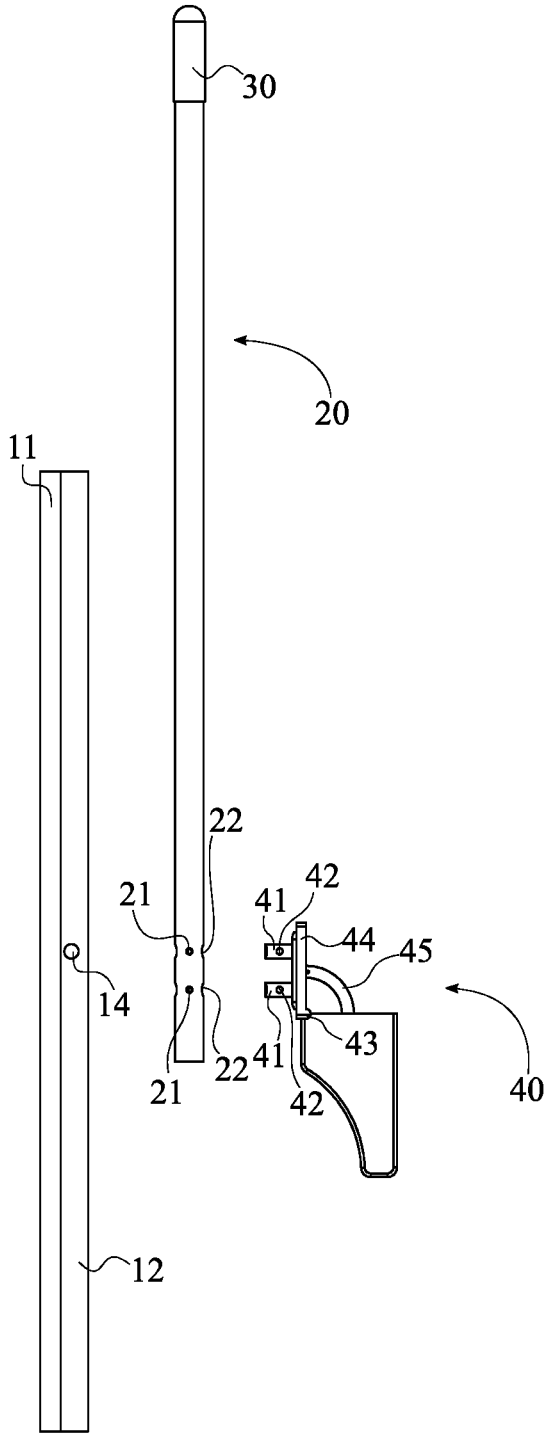
FIG. 9 is a top view of another embodiment of the present invention, showing the foldable handle and the plurality of pins of the bracket.
Figure 10:
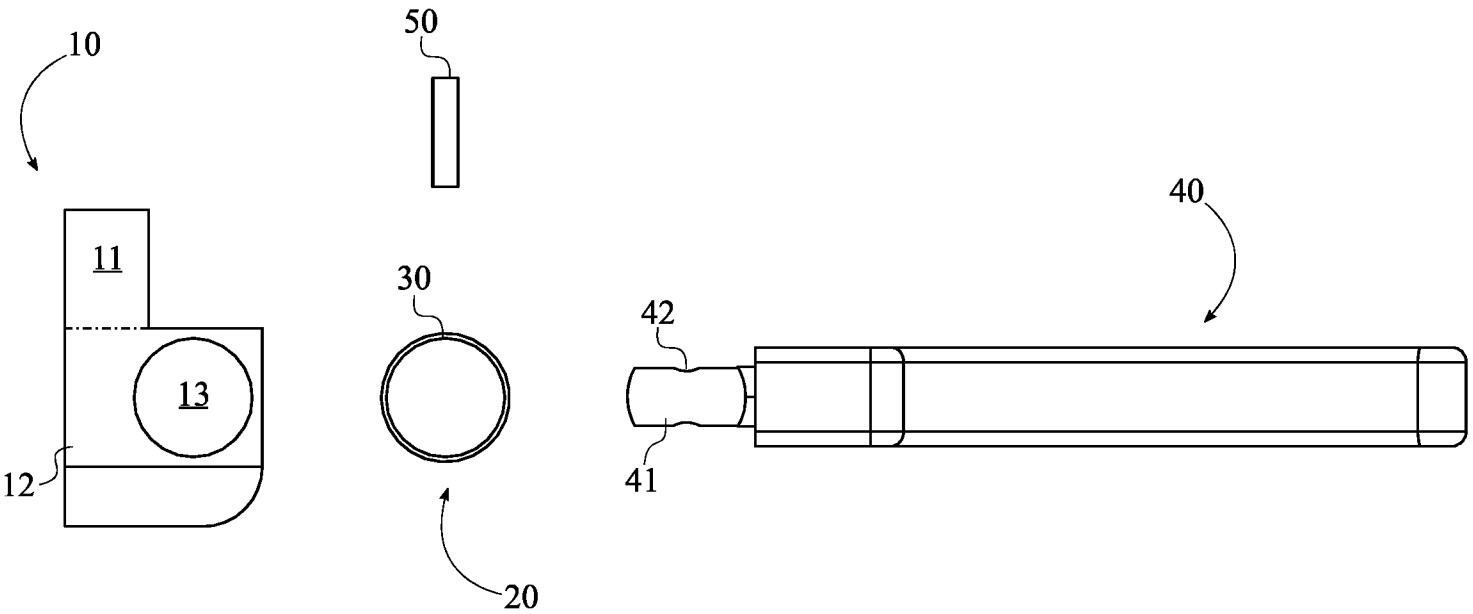
FIG. 10 is a front view of the preferred embodiment of the present invention, showing the plurality of pins of the handle.
Figure 13:
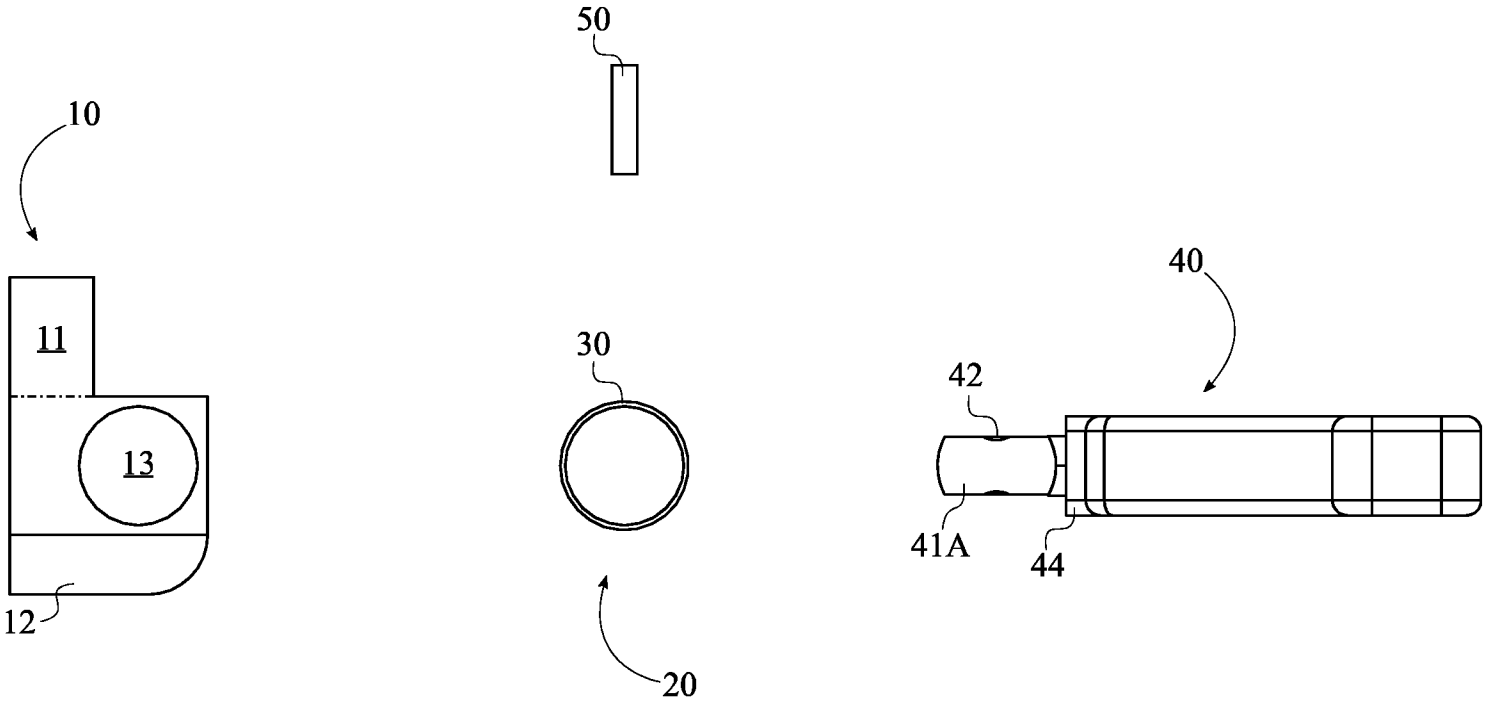
FIG. 13 is a front view of another embodiment of the present invention, showing the foldable handle and the protrusion of the bracket.
Figure 14:
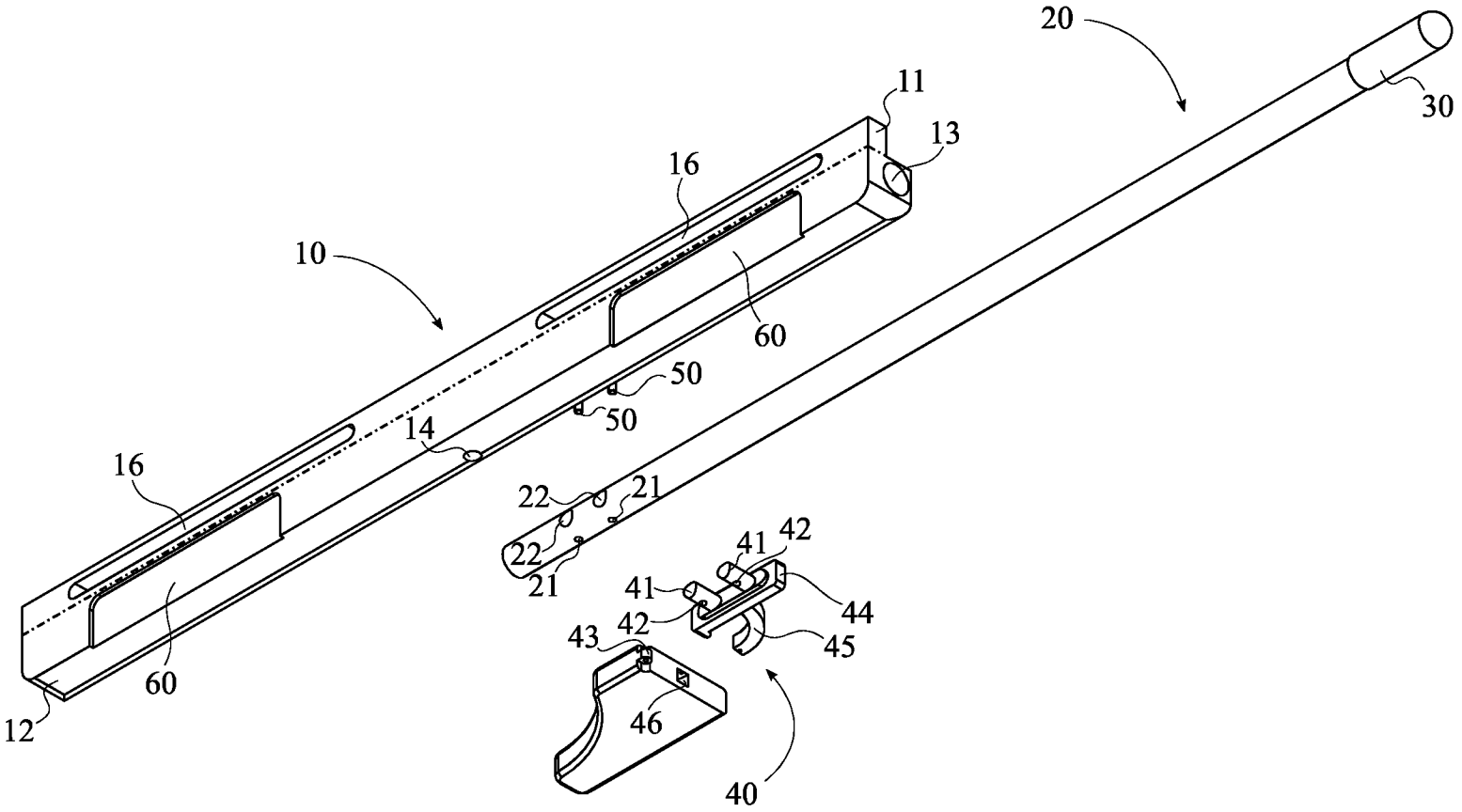
FIG. 14 is an exploded view of another embodiment of the present invention, showing the details of the foldable handle and the plurality of pins of the bracket.

In another embodiment, as seen in FIGS. 5, 7-9, 12, and 14, the handle 40 is foldable and comprises a hinge 43, a bracket 44, a spring-loaded stabilizer 45, a stabilizer aperture 46, the plurality of pins 41, and the plurality of through holes 42. The hinge 43 is terminally mounted to the handle 40 and connected to the bracket 44. The spring-loaded stabilizer 45 is mounted to the center of the bracket 44 opposite the plurality of pins 41. The stabilizer aperture 46 is positioned in the handle 40 and comprises a curved channel matching the profile of the spring-loaded stabilizer 45 as seen in FIG. 14. This configuration allows the user to turn the foldable handle 40 90 degrees to "on" and "off" positions. When the foldable handle 40 is turned to "on" position, the foldable handle 40 is oriented perpendicular to the handle sliding slot 15 of the block 10. The foldable handle 40 is secured in place by the spring-loaded stabilizer to allow the user to slide the rod 20 backward, thus, engaging and moving the charging handle of the rifle. When the foldable handle 40 is turned 90 degrees to be parallel to the handle sliding slot 15 of the block 10, the spring-loaded stabilizer 45 holds the handle 40 securely at this "off" position to prevent inference with any of the user's activity. The plurality of pins 41 is terminally and perpendicularly connected to the longitudinal surface of the bracket 44, opposite the hinge 43. Each of the plurality of through holes 42 is located on each of the plurality of pins 41. The axis of each of the plurality of through holes 42 is oriented perpendicular to and intersects the axis of each of the plurality of pins 41. The handle 40 is terminally connected to the rod 20 through the handle sliding slot 15 of the block 10 by first inserting the plurality of pins 41 of the bracket 44 into each of the second plurality of through holes of the rod 20, then inserting and tightening the plurality of fasteners 50 into the first plurality of through holes 22 of the rod 20 and each of the plurality of pins 41 of the bracket 44. In yet another embodiment, FIGS. 6 and 13, the handle 40 is foldable and comprises the protrusion 41A, instead of the plurality of pins 41.

The plurality of slots 16 is distributed across the flange 11 of the block 10. The flange 11 is terminally positioned on and traversing across the block body 12. At least one indentation 60 is located on the block body 12, opposite the plurality of slots 16 of the flange 11 along the block body 12, as seen in FIG. 4. In the preferred embodiment of the present invention, the plurality of slots 14 of the flange 11, and at least one indentation 60 of the block body 12, allow the user to attach to the present invention to either side of the Picatinny riser rail of an AR, M4, or SR25 flat top rifle. The plurality of slots 14 allows the user to adjust the position of the BullCharger when mounting the BullCharger to the Picatinny riser using a plurality of bolts, washers, and cap nuts. In other embodiments, one indentation 60 may be used to mount the BullCharger to the specific side of the Picatinny riser rail of a flat top rifle together with the plurality of slots 14 which is used for secure attachment. This feature provides the user ambidextrous configuration no matter if the user is left-handed or right-handed. The BullCharger must be installed on the opposite side of the ejecting port of the rifle.

To assemble the handle 40 onto the rod 20 in the preferred embodiment, the user first aligns the second plurality of through holes 22 on the rod 20 with the handle sliding slot 15 on the block body 12 of the block 10. The user inserts the plurality of pins 41 of the handle 40 into the second plurality of through holes 22 on the rod 20. In turn, the user aligns each of the first plurality of through holes 21 of the rod 20 with the second through hole 14 of the block 10, and each of the plurality of through holes of the handle 40 by sliding the rod 20 and handle 40 along the handle sliding slot 15.

Once aligned, the user inserts each of the plurality of fasteners 50 and tightens the fastener 50. The assembly process is the similar for the other embodiment of the present invention, wherein the protrusion 41A of the handle 40 is first inserted into the slot 22A of the rod 20 through the handle sliding slot 15. By aligning through holes on the block 10, the protrusion 41A, and the rod 20, the user inserts the fastener 50, on after another to securely attach the handle 40 to the rod 20 through the handle sliding slot 15.

To install and use the present invention, the user first acquires the BullCharger. The user then mounts the BullCharger on the Picatinny riser rail on the flat top of the rifle by first align the block 10 in front of the charging handle on the rifle with the end stopper 30 touching the charging handle. With one hand holding the BullCharger on the rifle, the user inserts the bolt with a washer through the Picatinny riser rail slot and then the plurality of slots on the flange 11 of the block 10. Subsequently, the user uses cap nuts to securely tighten the BullCharger onto the Picatinny riser rail. To operate the BullCharger, the user pulls the handle 40 backward while holding the rifle with one hand and aiming at the target. The handle 40 engages and moves the charging handle of the rifle. Once the charging handle reaches its end, the user releases the handle 40 of the BullCharger. At the same time, the charging handle returns to the original position and loads a round into the chamber. The rifle is ready to fire. For the BullCharger with a foldable handle 40, the user first rotates the handle 40 90 degrees from "off" position to "on" position so that the handle 40 is locked in place which is perpendicular to the rod 20 to allow the user to pull and load a round. Once the round is loaded, the user rotates the handle 40 back to "off" position, and the rifle is ready for use.

Although the invention has been explained in relation to its preferred embodiment, it is to be understood that many other possible modifications and variations can be made without departing from the spirit and scope of the invention as hereinafter claimed.

What is claimed is:

1. A BullCharger charging handle converter for an AR, M4, or SR25 flat top rifle comprising: a block; a rod; a handle; a plurality of fasteners; at least one indentation; the block comprising a block body, a flange, a handle sliding slot, a first through hole, a second through hole, and a plurality of slots; the first through hole traversing the block body; the plurality of slots being distributed across the flange; the rod comprising a first plurality of through holes and a second plurality of through holes; the rod being slidably positioned within the first through hole of the block; the handle comprising a plurality of pins and a plurality of through holes; the plurality of pins being terminally and perpendicularly connected to a lateral surface of the handle; each of the plurality of through holes being positioned centrally and perpendicularly on each of the plurality of pins; the plurality of pins of the handle being positioned within the handle sliding slot of the block; the handle being connected to the rod using the plurality of fasteners through the plurality of through holes of the rod and the plurality of pins; and at least one indentation being positioned on the block body, opposite the flange along the block body.

2. The BullCharger charging handle converter for an AR, M4, or SR25 flat top rifle as claimed in claim 1 comprising:

the handle being a foldable handle and comprising a hinge, a bracket, a spring-loaded stabilizer, and a stabilizer aperture;

the hinge being terminally mounted onto the lateral surface of the handle;

the bracket being connected to the hinge;

the spring-loaded stabilizer being mounted to the center of the bracket and the center of the lateral surface of the handle; and the stabilizer aperture being a curved channel within the handle; and the spring-loaded stabilizer being slidably connected to the stabilizer channel.

3. The BullCharger charging handle converter for an AR, M4, or SR25 flat top rifle as claimed in claim 1 comprising:

each of the plurality of fasteners being a roll pin.

4. The BullCharger charging handle converter for an AR, M4, or SR25 flat top rifle as claimed in claim 1 comprising:

each of the plurality of fasteners being a bolt and a nut.

5. The BullCharger charging handle converter for an AR, M4, or SR25 flat top rifle as claimed in claim 1 comprising:

each of the plurality of fasteners being a screw.

6. The BullCharger charging handle converter for an AR, M4, or SR25 flat top rifle as claimed in claim 1 comprising:

an end stopper; and the end stopper being terminally and concentrically connected to the rod opposite the first plurality of through holes.

7. A BullCharger charging handle converter for an AR, M4, or SR25 flat top rifle comprising: a block; a rod; a handle; a plurality of fasteners; at least one indentation; the block comprising a block body, a flange, a handle sliding slot, a first through hole, a second through hole, and a plurality of slots; the first through hole traversing the block body; the plurality of slots being distributed across the flange; the rod comprising a first plurality of through holes and a slot; the rod being slidably positioned within the first through hole of the block; the handle comprising a protrusion and a plurality of through holes; the protrusion being terminally and perpendicularly connected to a lateral surface of the handle; the plurality of through holes of the handle being positioned perpendicularly on the protrusion; the protrusion being positioned within the handle sliding slot of the block; the handle being connected to the rod using the plurality of fasteners through the plurality of through holes of the rod and the protrusion; and at least one indentation being positioned on the block body, opposite the flange along the block body.

8. The BullCharger charging handle converter for an AR, M4, or SR25 flat top rifle as claimed in claim 7 comprising:

the handle being a foldable handle and comprising a hinge, a bracket, a spring-loaded stabilizer, and a stabilizer aperture;

the hinge being terminally mounted onto the lateral surface of the handle;

the bracket being connected to the hinge;

the spring-loaded stabilizer being mounted to the center of the bracket and the center of the lateral surface of the handle; and the stabilizer aperture being a curved channel within the handle; and the spring-loaded stabilizer being slidably connected to the stabilizer channel.

9. The BullCharger charging handle converter for an AR, M4, or SR25 flat top rifle as claimed in claim 7 comprising:

each of the plurality of fasteners being a roll pin.

10. The BullCharger charging handle converter for an AR, M4, or SR25 flat top rifle as claimed in claim 7 comprising:

each of the plurality of fasteners being a bolt and a nut.

11. The BullCharger charging handle converter for an AR, M4, or SR25 flat top rifle as claimed in claim 6 comprising:

each the plurality of fasteners being a screw.

12. The BullCharger charging handle converter for an AR, M4, or SR25 flat top rifle as claimed in claim 7 comprising:

an end stopper; and the end stopper being terminally and concentrically connected to the rod opposite the first plurality of through holes.

* * * * *